US012076621B1

(12) United States Patent
Zhang

(10) Patent No.: US 12,076,621 B1
(45) Date of Patent: Sep. 3, 2024

(54) SKIPPING ROPE, METHOD AND DEVICE FOR ROPE SKIPPING COUNTING

(71) Applicant: Peilin Zhang, Beijing (CN)

(72) Inventor: Peilin Zhang, Beijing (CN)

( * ) Notice: Subject to any disclaimer, the term of this patent is extended or adjusted under 35 U.S.C. 154(b) by 0 days.

(21) Appl. No.: 18/391,324

(22) Filed: Dec. 20, 2023

(30) Foreign Application Priority Data

Oct. 26, 2023 (CN) ..... 202311404574.0

(51) Int. Cl.
*A63B 5/20* (2006.01)

(52) U.S. Cl.
CPC ..... *A63B 5/20* (2013.01); *A63B 2220/13* (2013.01); *A63B 2220/17* (2013.01); *A63B 2220/833* (2013.01)

(58) Field of Classification Search
CPC ... A63B 5/20; A63B 2220/13; A63B 2220/17; A63B 2220/833
See application file for complete search history.

(56) References Cited

U.S. PATENT DOCUMENTS 7,976,438 B1 * 7/2011 Hsu ..... A63B 5/20 482/81
2011/0115609 A1 * 5/2011 Gordon ..... A63B 71/0686 340/10.1
2012/0129653 A1 * 5/2012 Shalev ..... A63B 21/4035 482/1
2014/0018210 A1 * 1/2014 Lin ..... A63B 5/20 482/8
2017/0028241 A1 * 2/2017 Nurse ..... H02N 2/18
2018/0368738 A1 * 12/2018 Tong ..... A63B 21/0552
2019/0022448 A1 * 1/2019 Sandoval ..... A63B 5/20
2019/0255374 A1 * 8/2019 Constanza ..... A63B 24/0087
2020/0306585 A1 * 10/2020 Lin ..... G06V 40/161
2023/0181994 A1 * 6/2023 Liu ..... A63B 24/0062 482/8
2024/0033575 A1 * 2/2024 Kim ..... G06N 20/00

FOREIGN PATENT DOCUMENTS

CN 106807031 A * 6/2017
CN 107648790 A * 2/2018 ..... A63B 5/20
CN 114082130 A * 2/2022
CN 215741577 U * 2/2022
CN 112843586 B * 5/2022 ..... A63B 24/00
CN 219531942 U * 8/2023

OTHER PUBLICATIONS

Machine Translation of CN106807031 (Year: 2024).*
Machine Translation of CN114082130 (Year: 2024).*

* cited by examiner

*Primary Examiner* — Sundhara M Ganesan
(74) *Attorney, Agent, or Firm* — Maine Cernota & Curran

(57) ABSTRACT

A skipping rope, a method and a device for rope skipping counting are provided. The skipping rope includes: a skipping rope body, a rope skipping counting device, and a position and posture detector rotatably sleeved on the skipping rope body. The position and posture detector is configured to detect position and posture information of the skipping rope body, and the rope skipping counting device is configured to receive the position and posture information and perform rope skipping counting processing according to the position and posture information.

11 Claims, 5 Drawing Sheets

SKIPPING ROPE, METHOD AND DEVICE FOR ROPE SKIPPING COUNTING

CROSS-REFERENCE OF RELATED APPLICATIONS

The present application claims the priority of the Chinese patent application 202311404574.0, filed on Oct. 26, 2023 and entitled "SKIPPING ROPE, METHOD AND DEVICE FOR ROPE SKIPPING COUNTING", the entirety of which is incorporated herein by reference.

FIELD OF THE INVENTION

The present disclosure relates to the technical field of electronics, and in particular, to a skipping rope, a method and a device for rope skipping counting.

BACKGROUND

A skipping rope is fitness equipment of benefit to human health, and includes a rope (i.e., a skipping rope body) and two handles at two ends of the rope. When using the skipping rope, a person stands at a position corresponding to a middle of the rope and swings the handles counterclockwise or clockwise, so as to enable the rope to rotate in a circle from up to down. Rope skipping is of benefit to human health, and can also relieve stress of people, promote blood circulation and enhance physical fitness. Such exercise equipment, which is easy to use and is of great benefit to the human body, becomes more and more popular as demand changes.

In some scenarios, it is required to accurately count the number of rope skips. For example, in student physical education testing, the number of rope skips is used as the fitness performance of students; and in a rope skipping activity for daily physical exercise, counting rope skips enables people to know their rope skipping ability level and makes rope skipping more interesting. Conventional counting for rope skipping depends on mainly human visual observation, but such counting is prone to errors since it is difficult for the human eye to accurately observe the state of the rapidly moving skipping rope, and there may be calculation mistakes during human counting.

SUMMARY

Embodiments of the present disclosure provide a skipping rope, a method for rope skipping counting, and a device for rope skipping counting. Use of a position and posture detector on a skipping rope body to detect position and posture information of the skipping rope body during rope skipping so as to count the number of rope skips, improves the accuracy of counting.

According to an aspect of the present disclosure, a skipping rope is provided. The skipping rope includes: a skipping rope body, a rope skipping counting device and a position and posture detector rotatably sleeved on the skipping rope body. The position and posture detector is configured to detect position and posture information of the skipping rope body, and the rope skipping counting device is configured to receive the position and posture information and perform rope skipping counting processing according to the position and posture information.

In an embodiment, the rope skipping counting device includes a processor and a counter, and the processor is electrically connected to the position and posture detector and the counter.

In an embodiment, the position and posture detector is sleeved at a middle position of the skipping rope body.

In an embodiment, the skipping rope is further provided with a limiting structure for limiting sliding of the position and posture detector along the skipping rope body.

In an embodiment, the position and posture detector includes a hollow position and posture detector housing, a piezoelectric sensor, and a mass block. One side of the piezoelectric sensor is fixedly connected to the mass block, and the other side of the piezoelectric sensor, away from the mass block, is fixed on an inner wall of the position and posture detector housing. The position and posture detector is sleeved on the skipping rope body via the position and posture detector housing.

In an embodiment, the piezoelectric sensor is a piezoelectric ceramic sensor.

In an embodiment, the piezoelectric sensor has a mass greater than the mass of the mass block.

In an embodiment, the position and posture information includes voltage information, the processor includes a comparator, and the comparator is configured to determine the number of valid rope skips according to the voltage information and a preset reference voltage.

In an embodiment, the skipping rope further includes handles for fixing two ends of the skipping rope body, and the rope skipping counting device is provided in the handles.

In an embodiment, the skipping rope further includes a rectified energy storage power supply, and the rectified energy storage power supply is provided in the handles for fixing the two ends of the skipping rope body and is connected to the rope skipping counting device and the position and posture detector.

In an embodiment, the skipping rope further includes a Bluetooth module, and the Bluetooth module is provided in the handles for fixing the two ends of the skipping rope body and is connected to the rope skipping counting device.

In an embodiment, the position and posture detector is connected to the rope skipping counting device via an electric brush.

According to another aspect of the present disclosure, a method for rope skipping counting is provided. The method includes: acquiring position and posture information of a skipping rope body detected by a position and posture detector, the position and posture detector being rotatably sleeved on the skipping rope body of a skipping rope; and controlling a counter to perform rope skipping counting processing according to the position and posture information.

In an embodiment, the position and posture detector includes a hollow position and posture detector housing, a piezoelectric sensor, and a mass block; one side of the piezoelectric sensor is fixedly connected to the mass block, and the other side of the piezoelectric sensor, away from the mass block, is fixed on an inner wall of the position and posture detector housing; the position and posture detector is sleeved on the skipping rope body via the position and posture detector housing; and the piezoelectric sensor is a piezoelectric ceramic sensor and has a mass greater than the mass of the mass block; wherein acquisition of the position and posture information of the skipping rope body detected by the position and posture detector includes: acquiring voltage information detected by the piezoelectric sensor.

In an embodiment, the controlling the counter to perform the rope skipping counting processing according to the position and posture information includes: determining the number of valid rope skips according to the voltage information and a preset reference voltage; and controlling the counter to perform the rope skipping processing based on the number of valid rope skips.

In an embodiment, the determining the number of valid rope skips according to the voltage information and the preset reference voltage and controlling the counter to perform the rope skipping processing based on the number of valid rope skips include: acquiring the voltage information at a last time instant previous to a given time instant, in response to the voltage information acquired at the present time instant being greater than the preset reference voltage; and determining that one valid rope skip has been completed and controlling the counter to increment a count value by one, in response to the voltage information acquired at the last time instant previous to the present time instant being less than the preset reference voltage.

In an embodiment, the determination of the number of valid rope skips according to the voltage information and the preset reference voltage and controlling the counter to perform the rope skipping processing based on the valid number of valid rope skipping further include: controlling the counter to maintain a count value, in response to the voltage information acquired at the present time instant being less than or equal to the preset reference voltage; and/or controlling the counter to maintain the counting value, in response to the voltage information acquired at the present time instant being greater than the preset reference voltage and the voltage information acquired at the last time instant previous to the present time instant being greater than or equal to the preset reference voltage.

In an embodiment, the method for rope skipping counting further includes: receiving an instruction for resetting the counter, and resetting the count value of the counter to zero.

In an embodiment, the method for rope skipping counting further includes: sending the count value of the counter to a mobile terminal.

According to another aspect of the present disclosure, a device for rope skipping counting is provided. The device for rope skipping counting includes a processor and a memory for storing a program. The program includes an instruction, and the processor is configured to implement the above method for rope skipping counting when the processor invokes the instruction.

According to one or more technical solutions provided in the embodiments of the present disclosure, use of a position and posture detector on a skipping rope body to detect position and posture information of the skipping rope body during rope skipping so as to count the number of rope skips improves the accuracy of counting.

BRIEF DESCRIPTION OF THE DRAWINGS

Accompanying drawings of embodiments of the present disclosure are described below.

DETAILED DESCRIPTION OF THE EMBODIMENTS

Figure 1:
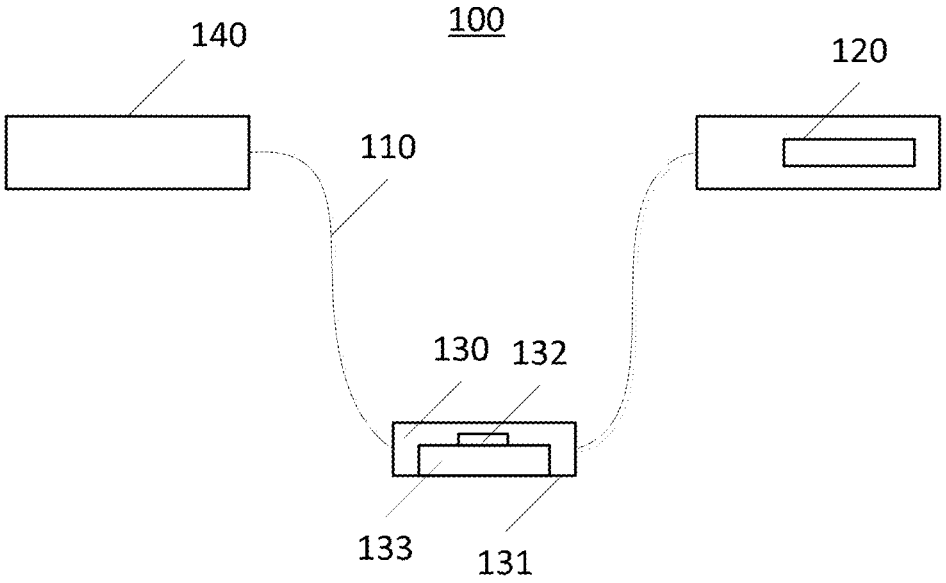
FIG. 1 shows a schematic diagram of a structure of a skipping rope according to an exemplary embodiment of the present disclosure.

Embodiments of the present disclosure will be described in more details with reference to accompanying drawings. Although some embodiments of the present disclosure are shown in the drawings, it should be understood that, the present disclosure may be implemented in various forms and shall not be explained as being limited by embodiments set forth herein, and on the contrary, these embodiments are provided for understanding the present disclosure thoroughly and completely. It should be understood that, the drawings and embodiments of the present disclosure are exemplary only, rather for limiting the protection scope of the present disclosure.

It should be understood that, respective steps recited in a method embodiment of the present disclosure may be performed in a different order, and/or in parallel. In addition, the method embodiment may include an additional step and/or omit a step shown. The scope of the present disclosure is not limited in this regard.

The term "comprise' and its variations used herein refer to an open-ended inclusion, i.e., "comprises but is not limited to". The term "based on" refers to "at least in part based on". The term "an embodiment" refers to "at least one embodiment"; the term "another embodiment" refers to "at least one another embodiment"; and the term "some embodiments" refers to "at least some embodiments". Relevant definitions of other terms will be provided in the following description. It should be noted that, concepts such as "first" and "second" mentioned in the present disclosure are used only for distinguishing different devices, modules, and units, rather than for limiting the order of functions executed by these devices, modules, and units or interdependent relations thereof.

It should be noted that, "one" and "more" mentioned in the present disclosure are exemplary rather than restrictive, and should be understood as "one or more" by those skilled in the art, unless otherwise clearly indicated in the context.

Names for messages or information exchanged among multiple devices in the embodiments of the present disclosure are only used for illustrative purpose, rather than for limiting the scope of the messages and information.

Solutions of the embodiments of the present disclosure are described below with reference to the drawings.

Rope skipping is a convenient exercise, and is more and more favored by the majority of users. In the related art, in order to avoid the inaccuracy due to the Conventional human counting for the number of rope skips, a solution of automatic counting by a smart device is used. Generally, a detection device is provided in a skipping rope handle for automatic counting in the related solution. Exemplarily, automatic counting for rope skipping includes three manners as follows based on different principles for detecting a position and posture of a skipping rope.

1) Automatic counting for rope skipping based on an inertial sensor: changes in acceleration of the skipping rope are sensed by the inertial sensor, i.e., an accelerometer or a gyroscope, mounted on the skipping rope handle during exercise, and the number of rope skips is obtained by a corresponding rope skipping position and posture determination logic by analyzing an acceleration signal and performing calculations. When the inertial sensor is used to detect the acceleration signal of the skipping rope during exercise, different people and different manners of rope skipping may lead to various changes in the position and posture of the skipping rope, resulting in differences in an acceleration curve. When there are large variations in acceleration patterns, errors will be very likely to occur in the skipping rope position and posture determination logic. This makes use of inertial sensors difficult in widespread application of automatic counting of rope skipping in various skipping scenarios. Besides, since the acceleration detection signal bandwidth of the inertial sensor is limited, the sensor cannot respond accurately to the change in acceleration in high-speed rope skipping, which could result in omission in counting. Inertial sensors are expensive as well.
2) Automatic counting for the rope skipping based on a photoelectric sensor: during rope skipping, a raster encoder is driven to rotate by the rope during rope skipping, a rotation position of the raster encoder is detected by an infrared light emitting and receiving module, and a counting circuit is used to count the rope skipping. Counting errors are avoided to a great extent through use of the raster encoder. However, on the one hand, the photoelectric coupling is prone to interference by dust contamination; and on the other hand, since its system structure is complicated, a high requirement for long-time use of the skipping rope is raised on the mechanical reliability of a rotation mechanism of the encoder.
3) Automatic counting for rope skipping based on visual recognition of a camera: a camera is used to shoot a user during rope skipping in real time, a rope skipping position and posture is determined by a corresponding position and posture recognition algorithm to process shot images, and a corresponding rope skipping movement logic determination algorithm is used to count the rope skipping. However, it is necessary to set up in advance or hold in hand a relatively fixed camera or other shooting device, and thus it is not convenient enough. Moreover, since the shooting angle of the camera is limited, if the user of the skipping rope moves during the rope skipping, the user of the skipping rope may easily go out of the shooting scope of the camera, so that the counting method fails.

Thus, the embodiments of the present disclosure provide a skipping rope. Use of a position and posture detector on a skipping rope body of the skipping rope to detect position and posture information of the skipping rope body during rope skipping, so as to count the number of the rope skipping, effectively improves the accuracy of counting, thereby improving user experience.

Figure 7:
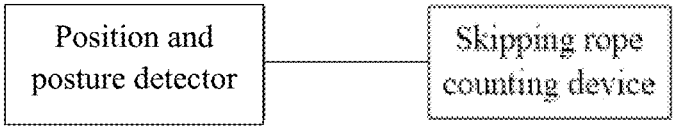
FIG. 7 shows a principle block diagram of a circuit in a skipping rope according to an exemplary embodiment of the present disclosure.

The skipping rope in the embodiments of the present disclosure is described in detail below. Please refer to FIG. 1 and FIG. 7, wherein FIG. 1 shows a schematic diagram of a structure of a skipping rope 100 according to an embodiment of the present disclosure, and FIG. 7 shows a principle block diagram of a circuit in the skipping rope according to an embodiment of the present disclosure. The skipping rope 100 includes: a skipping rope body 110, a rope skipping counting device 120, and a position and posture detector 130 rotatably sleeved on the skipping rope body 110. The position and posture detector 130 is configured to detect position and posture information of the skipping rope body 110, and the rope skipping counting device 120 is configured to receive the position and posture information and perform rope skipping counting processing according to the position and posture information.

In the embodiment of the present disclosure, the position and posture detector sleeved on the skipping rope body is used to detect the position and posture information of the skipping rope body, and then the rope skipping counting device is used to perform rope skipping counting processing according to the position and posture information. Thus, the skipping rope has a simple structure, low cost, and high counting accuracy.

Figure 8:
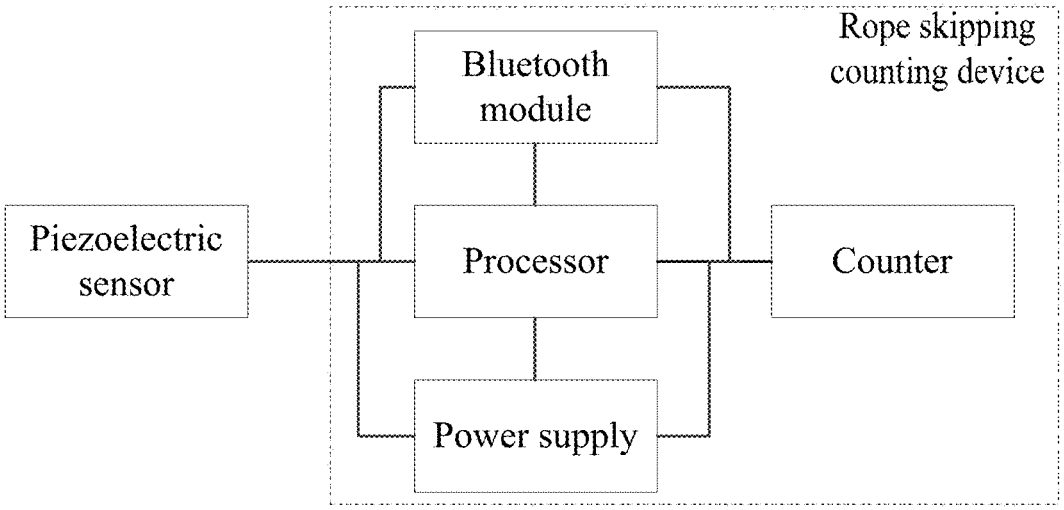
FIG. 8 shows another principle block diagram of a circuit in a skipping rope according to an exemplary embodiment of the present disclosure.

In some embodiments of the present disclosure, as shown in FIG. 8, the rope skipping counting device 120 includes a processor and a counter. The processor is electrically connected to the position and posture detector 130 and the counter. The processor receives the position and posture information from the position and posture detector 130, and controls the counter to perform rope skipping counting processing according to the position and posture information.

In some embodiments of the present disclosure, the position and posture detector 130 is sleeved at a middle position of the skipping rope body 110.

In some embodiments of the present disclosure, the skipping rope 100 is further provided with a limiting structure for limiting sliding of the position and posture detector 130 along the skipping rope body 110. The limiting structure is used to guarantee that the position and posture detector is located at the middle of the skipping rope body 110 all the time, so as to improve the detection accuracy of the position and posture detector 130. In addition, even if the rope skipping counting device 120 is provided in a handle 140 of the skipping rope and it is required to electrically connect the position and posture detector 130 with the rope skipping counting device 120 in a wired manner, dragging a conducting wire by the position and posture detector 130 may be avoided because of the limiting structure, thereby extending the service life of the skipping rope 100.

In some feasible manners, the limiting structure may be provided on the skipping rope body 110, and the limiting structure may be a limiting projection. In some feasible manners, the limiting structure may alternatively be provided on the position and posture detector 130. For example, a fastener is provided at an outside of the position and posture detector 130 which contacts with the skipping rope body 110, and the fastener is tightened on the skipping rope body, so that the position and posture detector 130 is guaranteed to be located at the middle of the skipping rope body 110 all the time during rope skipping exercise.

In some embodiments of the present disclosure, the position and posture detector 130 includes a hollow position and posture detector housing 131, a piezoelectric sensor 133, and amass block 132. One side of the piezoelectric sensor 133 is fixedly connected to the mass block 132, and the other side of the piezoelectric sensor 133, away from the mass block, is fixed on an inner wall of the position and posture detector housing 131. The position and posture detector 130 is sleeved on the skipping rope body 110 via the position and posture detector housing 131. The piezoelectric sensor 133 has a mass greater than the mass of the mass block 132. The piezoelectric sensor may be a piezoelectric ceramic sensor.

In a feasible manner, one side of the piezoelectric sensor 133 is fixedly connected to the mass block 132 by glue, and the other side of the piezoelectric sensor 133, away from the mass block 132, may be fixed on the inner wall of the position and posture detector housing 131 by strong glue. The fixation of the piezoelectric sensor 133 may alternatively be implemented by other manners, such as by a screw and the like, which is not limited in the embodiment of the present disclosure.

The position and posture detector housing 131 may be a hollow cylinder and is provided with a throughhole. The skipping rope body 110 passes through the throughhole, so that the position and posture detector 130 is sleeved on the skipping rope body 110 and is rotatable relative to the skipping rope body 110.

In some embodiments of the present disclosure, the skipping rope 100 may further include handles 140 for fixing two ends of the skipping rope body 110, and the rope skipping counting device 120 is provided in the handles 140. The length of the skipping rope body 110 may be adjusted by the handles 140. For example, the length of the skipping rope body 110 may be adjusted by shortening or extending the same length of the rope at its two handles.

Figure 2:
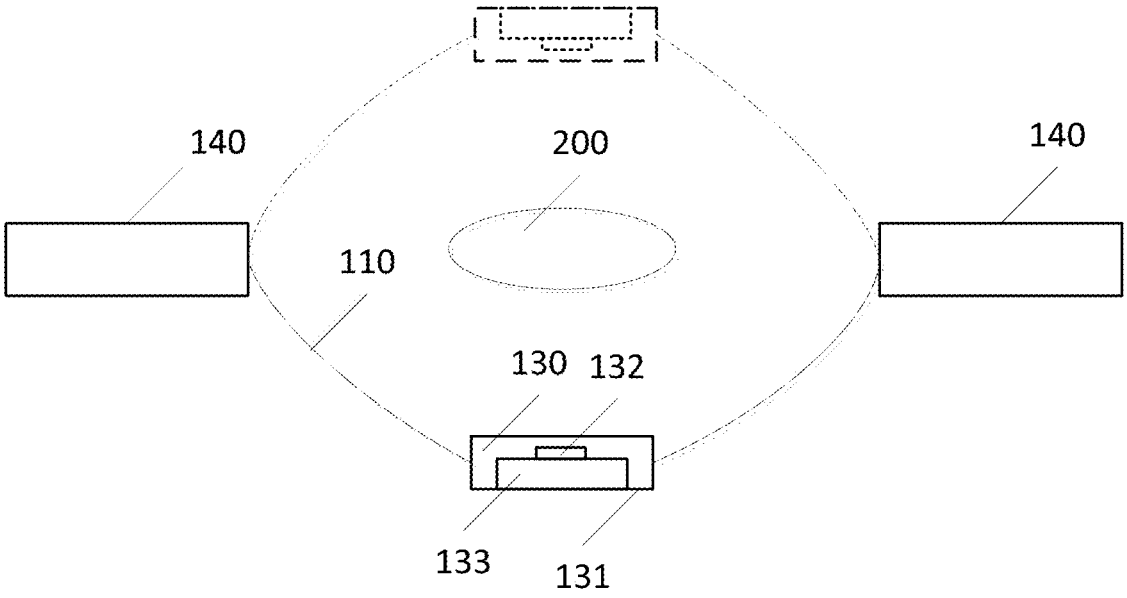
FIG. 2 shows a schematic diagram of a structure of a skipping rope during rope skipping according to an exemplary embodiment of the present disclosure.

In an embodiment, referring to FIG. 2, when the user 200 is rope skipping, the position and posture detector 130 may rotate freely around the skipping rope body 110, and the skipping rope body 110 rotates continuously around the user clockwise or counterclockwise. According to the principle of centrifugal force, a centrifugal force in a direction away from a rotation center is applied on an object during rotation of the object. A formula for the centrifugal force is expressed as:

$$F_o = m \cdot \frac{v^2}{r}, \tag{1}$$

where $F_o$ is a centrifugal force, m is the mass of an object, v is the velocity of angular motion of the object, and r is a radius of the angular motion.

Figure 3:
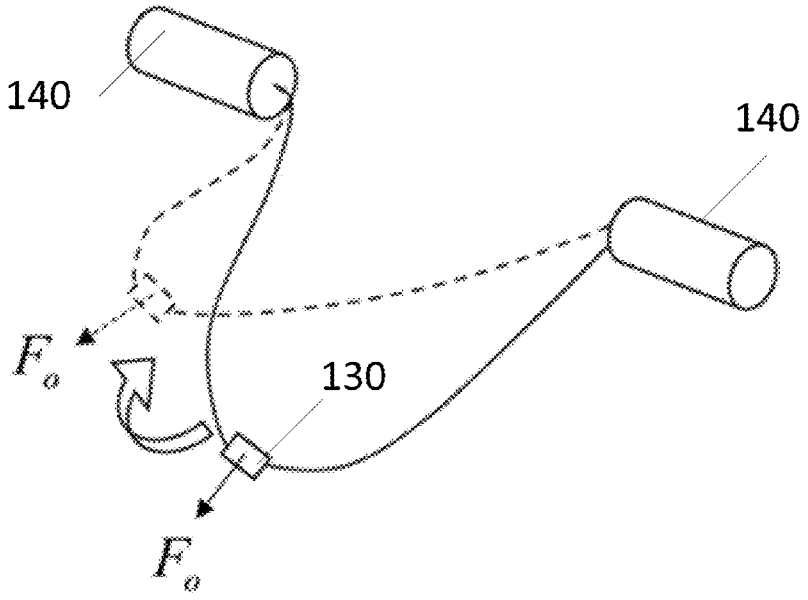
FIG. 3 shows a schematic diagram of a position and posture change of a skipping rope body during rope skipping according to an exemplary embodiment of the present disclosure.
Figure 4:
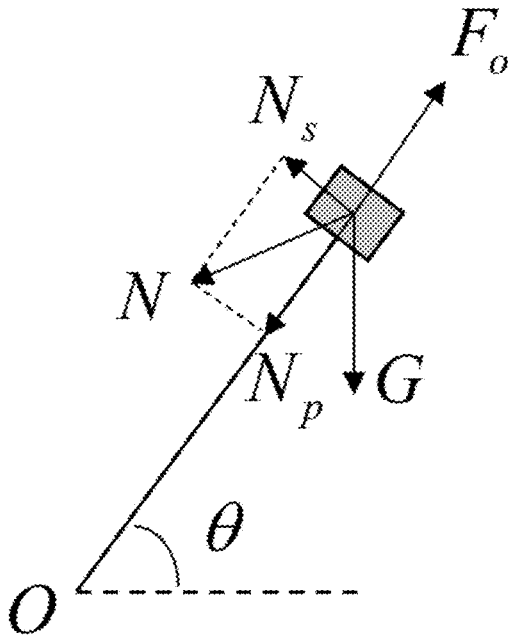
FIG. 4 shows a schematic diagram of forces on a mass block according to an exemplary embodiment of the present disclosure.

Since the speed for swinging the rope during the rope skipping exercise is relatively large, the centrifugal force applied on the piezoelectric ceramic sensor (the piezoelectric sensor 133) and the mass block 132 are relatively great, and the gravity may be ignored relative to the centrifugal force, and further since the mass of the piezoelectric ceramic sensor is greater than the mass of the mass block 132, the centrifugal force applied on the piezoelectric ceramic sensor is greater than the centrifugal force applied on the mass block 132 during the rope skipping exercise. When only the centrifugal force is in consideration, the piezoelectric ceramic sensor and the mass block 132 would drive the position and posture detector housing 131 to continuously rotate around the skipping rope body 110, so that the piezoelectric ceramic sensor is located at an outer circle, i.e., a side away from the user, of the skipping rope body all the time relative to the mass block 132 during the rope skipping exercise regardless of the position and posture of the skipping rope body 110, as shown in FIG. 3. A surface perpendicular to a user in a standing state and in the same surface with the center of the handles is regarded as a horizontal surface, a direction located in the horizontal surface and in the same orientation with the face of the user is regarded as the horizontal direction, and a direction away from the ground surface when the user is standing is regarded as a vertical direction, that is, reference may be made to a side view when the user 200 does rope skipping exercise. Assuming that the skipping rope body 110 has a position and posture angle θ relative to the horizontal direction, the mass block 132 is applied of a gravity G, a centrifugal force $F_o$, and a first pressure N from the piezoelectric ceramic sensor, and orientations of respective forces are shown in FIG. 4. The pressure N is resolved into a radial extrusion force component $N_p$ along the circumference of the skipping rope and a shearing force component $N_s$ along a tangent. Assuming that the skipping rope body enters a stable stage with a constant velocity during the rope skipping, i.e., the rotation velocity is approximately constant, and according to the force balance, the following formula may be obtained:

$$\begin{cases} N_p = F_o - G\sin\theta \\ N_s = G\cos\theta \end{cases}. \tag{2}$$

Figure 5:
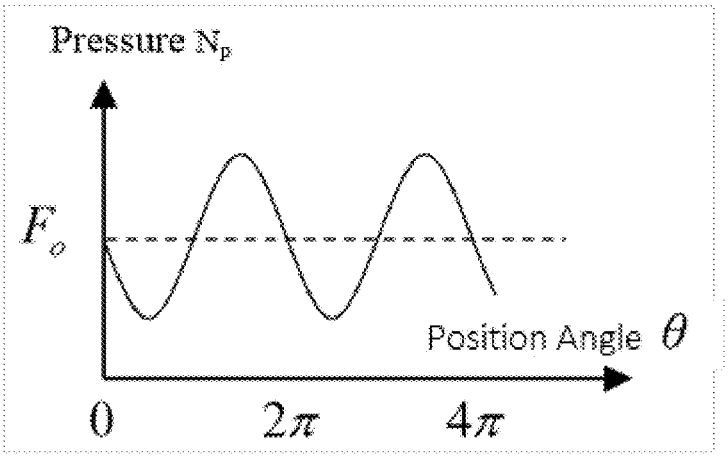
FIG. 5 shows a curve diagram of a pressure with a change of a position and posture angle of a skipping rope body when a piezoelectric ceramic sensor interacts with a mass block according to an exemplary embodiment of the present disclosure.
Figure 6:
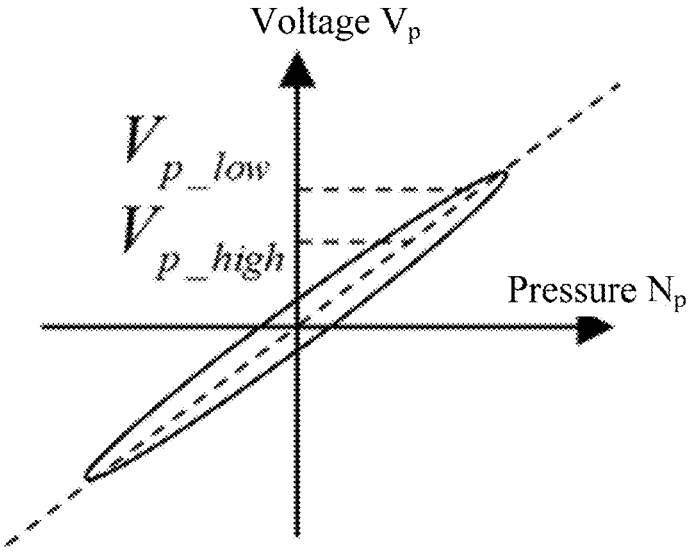
FIG. 6 shows a curve diagram of characteristics of a force on a piezoelectric ceramic sensor with a change of a voltage on the piezoelectric ceramic sensor according to an exemplary embodiment of the present disclosure.

According to the formula for the centrifugal force, the centrifugal force $F_o$ is approximately constant in the stable stage with a constant velocity, and therefore $N_p$ and $N_s$ change with a change of the position and posture angle θ. A curve of $N_p$ changing with the position and posture angle θ is shown in FIG. 5. Since 0 increases by 2π after the skipping rope rotates once in the same direction, $N_p$ goes through one cycle after the skipping rope rotates once. According to the Newton's third law, a second pressure applied on the piezoelectric ceramic sensor by the mass block 132 has a component equal to $N_p$ in a radial direction of the circumference of the skipping rope. According to the polarization effect of piezoelectric ceramics, polarization voltages $V_p$ with a corresponding magnitude will be generated at the two ends of the piezoelectric ceramic sensor when the pressure $N_p$ is applied on the piezoelectric ceramic sensor. A curve of characteristics of the pressure applied on the piezoelectric ceramic sensor and the polarization voltage are shown in FIG. 6. Hysteretic in the curve are ignored, and the polarization voltage and the pressure $N_p$ are considered to basically follow a linear relationship, i.e., $$V_p = k \cdot N_p, \tag{3}$$

where K is a constant.

According to the change relationship between $N_p$ and the position and posture angle θ, the polarization voltage $V_p$ of the piezoelectric ceramic sensor also changes periodically with the position and posture angle θ. Two special and extreme positions, i.e., the highest point (right above the head of the user) and the lowest point (under the feet of the user) of the skipping rope body during the rope skipping, correspond to a position and posture angle θ=π/2 and a position and posture angle θ=3π/2, respectively. The position and posture angle θ=π/2 and the position and posture angle θ=3π/2 are substituted into the formula (3) in which the polarization voltage changes with the pressure $N_p$ and into the formula (2), and corresponding polarization voltages, when the skipping rope body moves to the highest point and the lowest point, are expressed respectively as follows:

$$\begin{cases} V_{p_high} = k \cdot (F_o - G) \\ V_{p_low} = k \cdot (F_o + G) \end{cases}, \quad (3)$$

where $V_{p_high}$ and $V_{p_low}$ are the polarization voltages when the skipping rope body moves to the highest point and to the lowest point, respectively, i.e., the maximum value and the minimum value reached during the rope skipping exercise. Referring to FIG. 6, the polarization voltage fluctuates back and force between $V_{p_high}$ and $V_{p_low}$.

The position and posture information obtained by the detection of the piezoelectric ceramic sensor is voltage information, i.e., the above polarization voltage. Conducting wires drawn from the two ends of the piezoelectric ceramic sensor are connected to the rope skipping counting device 120 in the handles 140 along the inside of the skipping rope, and transmits the voltage information detected to the rope skipping counting device 120.

In some embodiments of the present disclosure, the processor of the rope skipping counting device 120 includes a comparator, and the comparator determines the number of valid rope skips according to the voltage information and a preset reference voltage.

The step of determining by the comparator the number of valid rope skips according to the voltage information and the preset reference voltage includes: determining the number of valid rope skips according to the voltage information and the preset reference voltage, and controlling the counter to perform rope skipping processing.

In some embodiments of the present disclosure, a preset reference voltage $V_{ref}$ may be set according to an empirical value; and the preset reference voltage $V_{ref}$ may alternatively be set according to the polarization voltage.

In some embodiments of the present disclosure, the preset reference voltage $V_{ref}$ may be an average value of polarization voltages $V_p$ of the piezoelectric ceramic sensor in a preset time period, for example, an average value in the last 5 seconds, an average value in the last 10 seconds, an average value in any continuous 5 seconds, an average value in any continuous 10 seconds, and the like, which is not limited in the embodiments of the present disclosure.

In some embodiments of the present disclosure, the comparator may be a hysteresis comparator, so as to prevent counting errors or mistakes due to jitter of the polarization voltage close to and caused by interference of the reference voltage $V_{ref}$.

In some embodiments of the present disclosure, the step of determining the number of valid rope skips according to the voltage information and the preset reference voltage and controlling the counter to perform the rope skipping processing include: in response to a voltage in the voltage information acquired at a given time instant being greater than the preset reference voltage, acquiring the voltage information at a last time instant previous to the present time instant; and in response to the voltage in the voltage information acquired at the last time instant previous to the present time instant being less than the preset reference voltage, determining completing valid one time of rope skipping, and controlling the counter to increment a count value by one.

In some embodiments of the present disclosure, the step of determining the number of valid rope skips according to the voltage information and the preset reference voltage and controlling the counter to perform the rope skipping processing include: in response to a voltage in the voltage information acquired at the present time instant being less than or equal to the preset reference voltage, controlling the counter to maintain a counting value; and/or in response to the voltage in the voltage information acquired at the present time instant being greater than the preset reference voltage and the voltage information acquired at a last time instant previous to the present time instant being greater than or equal to the preset reference voltage, controlling the counter to maintain the counting value.

In some embodiments of the present disclosure, in order to avoid twist and knot of the conducing wire during the rope skipping exercise, the conducting wire at the piezoelectric sensor 133 is connected via an electric brush to the conducting wire at the rope skipping counting device in the handle 140.

In some embodiments of the present disclosure, as shown in FIG. 8, the skipping rope further includes a power supply in the handle. The handles are configured to fix the two ends of the skipping rope body. The power supply is connected to the rope skipping counting device and the position and posture detector, and supplies power to the rope skipping counting device and the position and posture detector. In a feasible manner, the power supply is a rectified energy storage power supply, and the rectified energy storage power supply may be charged by the polarization voltage of the piezoelectric ceramic sensor, thereby avoiding using an external batter and guaranteeing normal working of the skipping rope and reducing the usage cost.

In some embodiments of the present disclosure, the skipping rope further includes a Bluetooth module in the handles. The Bluetooth module is connected to the rope skipping counting device, and the power supply may supply power to the Bluetooth module.

In the skipping rope in the embodiments of the present disclosure, the piezoelectric ceramic sensor is used to sense and detect an extrusion pressure of the mass block, the position and posture information of the skipping rope body during the rope skipping exercise is recognized and transmitted to the rope skipping counting device, and the rope skipping counting device detects the position and posture information and performs the rope skipping counting processing to further determine the number of valid rope skips. Since the gravity at the middle of the skipping rope body is downward all the time and the centrifugal force applied continuously changes with the change of the position and posture of the skipping rope body, the polarization voltage of the piezoelectric ceramic sensor accurately reflects the position and posture of the skipping rope body and is not susceptible to external environment interference, thereby greatly improving the accuracy of counting.

The position and posture detector including the piezoelectric ceramic sensor, the mass block, and the position and posture detector housing is sleeved on the middle position of the skipping rope body; and the position and posture detector has a small volume, a light weight, a compact structure, and a high level of integration, and is not dependent on any mechanical movement mechanism, thereby greatly improving the mechanical strength of the position and posture detector and the service life and operational reliability of the skipping rope.

The piezoelectric ceramic sensor has a lower price relative to an accelerometer, a raster encoder and the like, thereby greatly reducing the usage cost.

A method for rope skipping counting in an embodiment of the present disclosure is described below.

Figure 9:
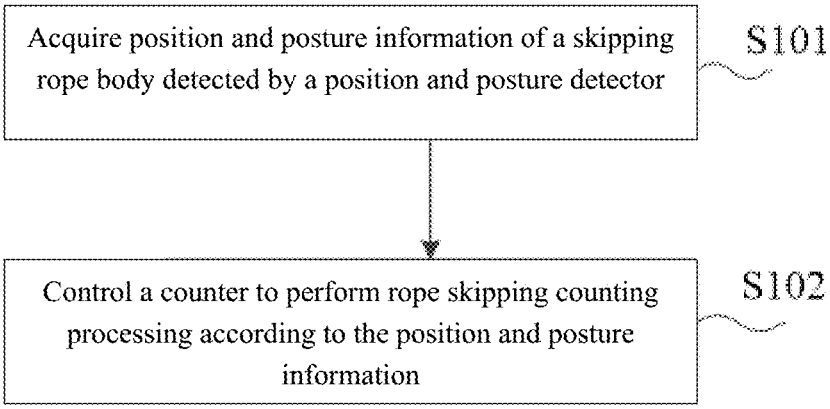
FIG. 9 shows a flowchart of a method for rope skipping counting according to an exemplary embodiment of the present disclosure.

FIG. 9 shows a schematic flowchart of a method for rope skipping counting according to an embodiment of the present disclosure, and the method includes: S101, acquiring position and posture information of a skipping rope body detected by a position and posture detector, the position and posture detector being rotatably sleeved on the skipping rope body of a skipping rope; and S102, controlling a counter to perform rope skipping counting processing according to the position and posture information.

In the embodiment of the present disclosure, the position and posture detector is sleeved on the skipping rope body and is used to detect the position and posture information of the skipping rope body, and then the rope skipping counting processing is performed according to the position and posture information, so that the skipping rope has a simple structure, low cost, and high counting accuracy.

In some embodiments of the present disclosure, the position and posture detector includes a hollow position and posture detector housing, a piezoelectric sensor, and a mass block. One side of the piezoelectric sensor is fixedly connected to the mass block, and the other side of the piezoelectric sensor, away from the mass block, is fixed on an inner wall of the position and posture detector housing. The position and posture detector is sleeved on the skipping rope body via the position and posture detector housing. The piezoelectric sensor is a piezoelectric ceramic sensor. The piezoelectric sensor has a mass greater than the mass of the mass block. In this case, the above step S101 of acquiring the position and posture information of the skipping rope body detected by the position and posture detector includes: acquiring voltage information detected by the piezoelectric sensor.

In some embodiments of the present disclosure, the above step S102 of controlling the counter to perform the rope skipping counting processing according to the position and posture information includes: S1021, determining the number of valid rope skips according to the voltage information and a preset reference voltage; and S1022, controlling the counter to perform the rope skipping processing based on the number of valid rope skips.

As mentioned above, in an embodiment, referring to FIG. 2, during the rope skipping of the user 200, the position and posture detector 130 may rotate freely around the skipping rope body 110, and the skipping rope body 110 rotates continuously around the user clockwise or counterclockwise. According to the principle of centrifugal force, a centrifugal force in a direction away from a rotation center is applied on the object during rotation. The centrifugal force may be calculated based on the above formula (1), which is not repeated herein in detail.

Since the speed for swinging the rope during the rope skipping exercise is relatively large, the centrifugal force applied on the piezoelectric ceramic sensor (the piezoelectric sensor 133) and the mass block 132 are relatively great, and the gravity may be ignored relative to the centrifugal force, and further since the mass of the piezoelectric ceramic sensor is greater than the mass of the mass block 132, the centrifugal force applied on the piezoelectric ceramic sensor is greater than the centrifugal force applied on the mass block 132 during the rope skipping exercise. When only the centrifugal force is in consideration, the piezoelectric ceramic sensor and the mass block 132 would drive the position and posture detector housing 131 to continuously rotate around the skipping rope body 110, so that the piezoelectric ceramic sensor is located at an outer circle, i.e., a side away from the user, of the skipping rope body all the time relative to the mass block 132 during the rope skipping exercise regardless of the position and posture of the skipping rope body 110, as shown in FIG. 3. A surface perpendicular to a user in a standing state and in the same surface with the center of the handle is regarded as a horizontal surface, a direction located in the horizontal surface and in the same orientation with the face of the user is regarded as the horizontal direction, and a direction away from the ground surface when the user is standing is regarded as a vertical direction, that is, reference may be made to a side view when the user 200 does rope skipping exercise. Assuming that the skipping rope body 110 has a position and posture angle θ relative to the horizontal direction, the mass block 132 is applied of a gravity G, a centrifugal force $F_o$, and a first pressure N from the piezoelectric ceramic sensor, and orientations of respective forces are shown in FIG. 4. The pressure N is resolved into a radial extrusion force component $N_p$ along the circumference of the skipping rope and a shearing force component $N_s$ along a tangent. Assuming that the skipping rope body enters a stable stage with a constant velocity during the rope skipping, i.e., the rotation velocity is approximately constant, according to the force balance a relationship between the extrusion force component $N_p$ of the first pressure N along the radial of the circumference of the skipping rope and the position and posture angle θ may be obtained, and a relationship between the shearing force component $N_s$ of the first pressure N along the tangent and the position and posture angle θ may be obtained. Reference may be made to the above formula (2), which is not repeated in detail herein.

According to the formula (1) for the centrifugal force, the centrifugal force $F_o$ is approximately constant in the stable stage with a constant velocity, and therefore $N_p$ and $N_s$ change with a change of the position and posture angle θ. A curve of $N_p$ changing with the position and posture angle θ is shown in FIG. 5. Since 0 increases by 2π after the skipping rope rotates once in the same direction, $N_p$ goes through one cycle after the skipping rope rotates once. According to the Newton's third law, a second pressure applied on the piezoelectric ceramic sensor by the mass block 132 has a component equal to $N_p$ in a radial direction of the circumference of the skipping rope. According to the polarization effect of piezoelectric ceramics, polarization voltages $V_p$ with a corresponding magnitude will be generated at two ends of the piezoelectric ceramic sensor when the pressure $N_p$ is applied on the piezoelectric ceramic sensor. A curve of characteristics of the pressure applied on the piezoelectric ceramic sensor and the polarization voltage are shown in FIG. 6. Hysteretic in the curve are ignored, and the polarization voltage and the pressure $N_p$ are considered to basically follow a linear relationship, i.e., the above formula (3), which is not repeated in detail herein.

According to the change relationship between $N_p$ and the position and posture angle θ, the polarization voltage $V_p$ of the piezoelectric ceramic sensor also changes periodically with the position and posture angle θ. Two special and extreme positions, i.e., the highest point (right above the head of the user) and the lowest point (under the feet of the user) of the skipping rope body during the rope skipping, correspond to a position and posture angle θ=π/2 and a position and posture angle θ=3π/2, respectively. The position and posture angle θ=π/2 and the position and posture angle θ=3π/2 are substituted into the formula (3) in which the polarization voltage changes with the pressure $N_p$ and into the formula (2), and corresponding polarization voltages, when the skipping rope body moves to the highest point and the lowest point, are calculated based on the above formula (4), which is not repeated in detail herein.

In formula (4), $V_{p_high}$ and $V_{p_low}$ are the polarization voltages when the skipping rope body moves to the highest point and the lowest point, respectively, i.e., the maximum value and the minimum value reached during the rope skipping exercise. Referring to FIG. 6, the polarization voltage fluctuates back and force between $V_{p_high}$ and $V_{p_low}$.

In the embodiment of the present disclosure, the counting for rope skipping is performed by the position and posture detector with the above structure. Use of the piezoelectric ceramic sensor in the position and posture detector to sense the extrusion pressure of the mass block and output the polarization voltage enables the position and posture detector to accurately recognize the position and posture information of the skipping rope body during the rope skipping exercise, so as to accurately determine the number of valid rope skips.

In some embodiments of the present embodiments, in order to further improve the accuracy of the position and posture information, a limiting structure for limiting sliding of the position and posture detector 130 along the skipping rope body 110 may be provided on the skipping rope body. By the limiting structure, the position and posture detector may be guaranteed to be located at the middle of the skipping rope body 110 all the time, so as to improve the detection accuracy of the position and posture detector 130. In addition, even if the rope skipping counting device 120 is provided in a handle 140 of the skipping rope and it is required to electrically connect the position and posture detector 130 with the rope skipping counting device 120 in a wired manner, dragging a conducting wire by the position and posture detector 130 is avoided by the limiting structure, thereby extending the service life of the skipping rope 100.

The manner and position for arranging the limiting structure may be referred to the description of the above embodiment of the skipping rope, which is not repeated in detail herein. It should be noted that, the manner and position for arranging the limiting structure is not limited to the example of the embodiment of the present disclosure, and any limiting structure is acceptable as long as the position and posture detector 130 may be guaranteed to be located at the middle position of the skipping rope body 110 all the time during the rope skipping exercise.

In some embodiments of the present disclosure, fixation relationships among the piezoelectric sensor 133, the mass block 132, and the position and posture detector housing 131 in the position and posture detector may be referred to related description in the above embodiment of the skipping rope for, which is not repeated in detail herein.

In some embodiments of the present disclosure, the above steps S1021 to S1022, i.e., determining the number of valid rope skips according to the voltage information and the preset reference voltage, and controlling the counter to perform the rope skipping processing based on the number of valid rope skips, include: in response to a voltage in the voltage information acquired at a given time instant being greater than the preset reference voltage, acquiring voltage information at a last time instant previous to the present time instant; and in response to the voltage in the voltage information acquired at the last time instant previous to the present time instant being less than the preset reference voltage, determining completing valid one time of rope skipping, and controlling the counter to increment a count value by one.

In some embodiments of the present disclosure, the above steps S1021 to S1022, i.e., determining the number of valid rope skips according to the voltage information and the preset reference voltage, and controlling the counter to perform the rope skipping processing based on the number of valid rope skips, further includes: in response to a voltage in the voltage information acquired at the present time instant being less than or equal to the preset reference voltage, controlling the counter to maintain a counting value; and/or in response to the voltage in the voltage information acquired at the present time instant being greater than the preset reference voltage and the voltage information acquired at a last time instant previous to the present time instant being greater than or equal to the preset reference voltage, controlling the counter to maintain the counting value.

In some embodiments of the present disclosure, a preset reference voltage $V_{ref}$ may be set according to an empirical value; and the preset reference voltage $V_{ref}$ may alternatively be set according to the polarization voltage.

In some embodiments of the present disclosure, the preset reference voltage $V_{ref}$ may be an average value of polarization voltages $V_p$ of the piezoelectric ceramic sensor in a preset time period, for example, an average value in the last 5 seconds, an average value in the last 10 seconds, an average value in any continuous 5 seconds, an average value in any continuous 10 seconds, and the like, which is not limited in the embodiments.

In some embodiments of the present disclosure, the comparator may be a hysteresis comparator, so as to prevent counting errors or mistakes due to jitter of the polarization voltage close to and caused by interference of the reference voltage $V_{ref}$.

Figure 10:
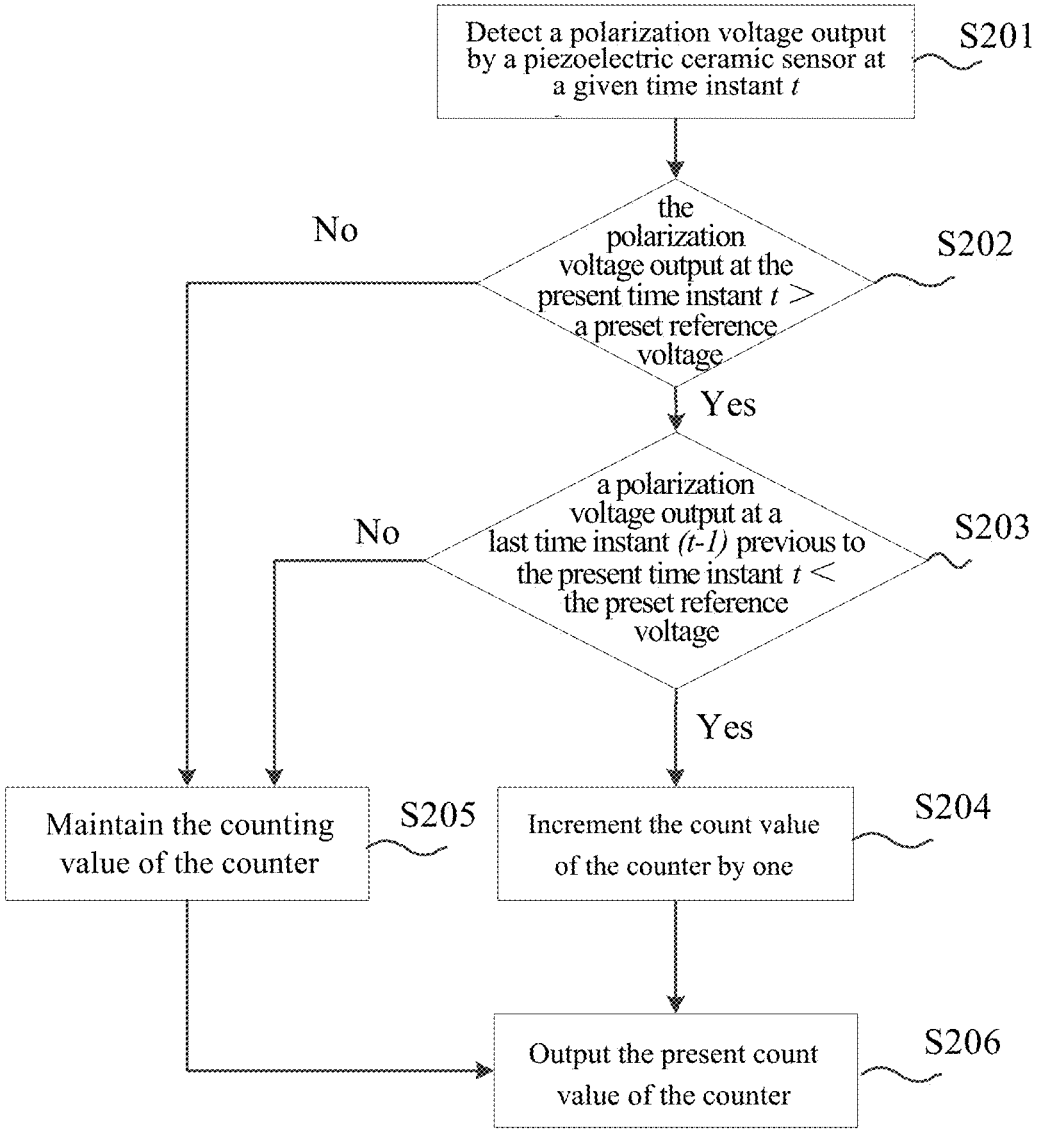
FIG. 10 shows a flowchart of another method for rope skipping counting according to an exemplary embodiment of the present disclosure.

Referring to FIG. 10, FIG. 10 shows a flowchart of another method for rope skipping counting according to an embodiment of the present disclosure, and the method includes: S201, detecting a polarization voltage output by a piezoelectric ceramic sensor at a given time instant t; S202, determining whether the polarization voltage output at the present time instant t is greater than a preset reference voltage, entering step S203 if yes, and entering step S205 if no; S203, determining whether a polarization voltage output at a last time instant t−1 previous to the present time instant t is less than the preset reference voltage, entering step S204 if yes, and entering step S205 if no; S204, controlling a counter to increment the count value by one, and entering step S206; S205, controlling the counter to maintain the counting value, and entering step S206; and S206, outputting a present count value of the counter.

After the above step 206, whether the rope skipping ends may be further determined. If the rope skipping ends, a final present count value is output, or otherwise, the step of detecting the polarization voltage output by the piezoelectric ceramic sensor is performed repeatedly, i.e., continuing to detect the polarization voltage output by the piezoelectric ceramic sensor at a next time instant, so as to continuously perform counting in real time.

In some embodiments of the present disclosure, the method for rope skipping counting may further includes: receiving an instruction for resetting the counter, and resetting the count value of the counter to zero.

The instruction for resetting the counter may be sent by the user via a mobile terminal. For example, communication between the mobile terminal and the skipping rope is established by the user via, such as Bluetooth, and the user operates the mobile terminal to send the instruction for resetting the counter to the skipping rope. After receiving the instruction for resetting the counter sent by the user, the processor resets the count value of the counter to zero directly. The mobile terminal may be a device, such as a smart phone, a smart watch, a smart bracelet, a tablet computer, and an earphone, which is not limited in the embodiments of the present disclosure.

The instruction for resetting the counter may alternatively be sent by a user operation on the skipping rope, for example, by pressing a button for resetting on the skipping rope, so as to reset the count value of the counter to zero.

In some embodiments of the present disclosure, the method for rope skipping counting may further include: sending the count value of the counter to the mobile terminal. For example, the count value of the counter is sent to the mobile terminal of the user via a Bluetooth module, and the count value is displayed on a display screen of the mobile terminal or broadcasted via voice, so as to improve the user experience.

In some embodiments of the present disclosure, the position and posture detector including the piezoelectric ceramic sensor, the mass block, and the position and posture detector housing is sleeved on the skipping rope body, and the position and posture detector has a small volume, a light weight, a compact structure, and a high level of integration, and is not dependent on any mechanical movement mechanism, thereby greatly improving the mechanical strength of the position and posture detector and the service life and operational reliability of the skipping rope. Use of the piezoelectric ceramic sensor to sense the extrusion pressure of the mass block and output the polarization voltage enables the position and posture detector to accurately recognize the position and posture information of the skipping rope body during the rope skipping exercise and prevents interference by the external environment, thereby greatly improving the accuracy of counting. In addition, the piezoelectric ceramic sensor has a lower price relative to the accelerometer, the raster encoder and the like, and greatly reduces the usage cost.

Embodiments of the present disclosure further provide a device for rope skipping counting, and the device includes a processor and a memory communicatively connected to the processor. The memory stores a program executable by the processor, and the program includes an instruction. When the processor invokes the instruction, the processor may implement the method for rope skipping counting in any of the above embodiments.

In some embodiments of the present disclosure, when the processor invokes the instruction, the processor may perform the following steps: acquiring position and posture information of a skipping rope body detected by a position and posture detector, the position and posture detector being rotatably sleeved on the skipping rope body of a skipping rope; and controlling a counter to perform rope skipping counting processing according to the position and posture information.

In some embodiments of the present disclosure, in the steps performed by the processor, the acquiring the position and posture information of the skipping rope body detected by the position and posture detector includes: acquiring the voltage information detected by the piezoelectric sensor. The position and posture detector includes a hollow position and posture detector housing, a piezoelectric sensor, and a mass block. One side of the piezoelectric sensor is fixedly connected to the mass block, and the other side of the piezoelectric sensor, away from the mass block, is fixed on an inner wall of the position and posture detector housing. The position and posture detector is sleeved on the skipping rope body via the position and posture detector housing. The piezoelectric sensor is a piezoelectric ceramic sensor. The piezoelectric sensor has a mass greater than the mass of the mass block.

In some embodiments of the present disclosure, in the steps performed by the processor, the controlling the counter to perform the rope skipping counting processing according to the position and posture information includes: determining the number of valid rope skips according to the voltage information and a preset reference voltage; and controlling the counter to perform rope skipping processing based on the number of valid rope skips.

In some embodiments of the present disclosure, in the steps performed by the processor, the determining the number of valid rope skips according to the voltage information and the preset reference voltage and controlling the counter to perform the rope skipping processing based on the number of valid rope skips include: acquiring voltage information at a last time instant previous to a given time instant, in response to a voltage in the voltage information acquired at the present time instant being greater than the preset reference voltage; and determining that one valid rope skip has been completed and controlling the counter to increment a count value by one, in response to the voltage in the voltage information acquired at the last time instant previous to the present time instant being less than the preset reference voltage.

In some embodiments of the present disclosure, when the processor performs the steps of determining the number of valid rope skips according to the voltage information and the preset reference voltage and controlling the counter to perform the rope skipping processing based on the number of valid rope skips, the processor is further configured to perform: controlling the counter to maintain a counting value, in response to the voltage in the voltage information acquired at the present time instant being less than or equal to the preset reference voltage; and/or controlling the counter to maintain the counting value, in response to the voltage in the voltage information acquired at the present time instant being greater than the preset reference voltage and the voltage information acquired at the last time instant previous to the present time instant being greater than or equal to the preset reference voltage.

In some embodiments of the present disclosure, the processor is further configured to perform the following step: receiving an instruction for resetting the counter, and resetting the count value of the counter to zero.

In some embodiments of the present disclosure, the processor is further configured to perform the following step: sending the count value of the counter to a mobile terminal.

The above description only involves preferred embodiments and technical principles used in the present disclosure. Those skilled in the art can understand that the present disclosure is not limited to specific embodiments described herein, and for those skilled in the art, various evident variations, re-adjustments and substitutions can be made without departing from the protection scope of the present disclosure. Therefore, although the present disclosure is described in detail in the above embodiments, the present disclosure is not limited to the above embodiments. Without departing from the concept of the present disclosure, more other equivalent embodiments may further be included, and the scope of the present disclosure is defined by the appended claims.

What is claimed is:

1. A skipping rope, comprising: a skipping rope body, a rope skipping counting device, and a pose detector rotatably sleeved on the skipping rope body, wherein the pose detector is configured to detect pose information of the skipping rope body, and the rope skipping counting device is configured to receive the pose information and perform rope skipping counting processing according to the pose information;

the pose detector is sleeved at a middle position of the skipping rope body, and the pose detector is connected to the rope skipping counting device via an electric brush;

the pose detector comprises a hollow pose detector housing, a piezoelectric sensor, and a mass block; one side of the piezoelectric sensor is fixedly connected to the mass block, and the other side of the piezoelectric sensor far away from the mass block is fixed on an inner wall of the pose detector housing; and the pose detector is sleeved on the skipping rope body via the pose detector housing; and the piezoelectric sensor is a piezoelectric ceramic sensor and has a mass greater than a mass of the mass block.

2. The skipping rope of claim 1, wherein the rope skipping counting device comprises a processor and a counter, the processor is electrically connected to the pose detector and the counter, the pose information comprises voltage information, the processor comprises a comparator, and the comparator is configured to determine the valid number of rope skipping according to the voltage information and a preset reference voltage.

3. The skipping rope of claim 1, further comprising a limiting structure for limiting sliding of the pose detector along the skipping rope body, wherein the skipping rope further comprises handles for fixing two ends of the skipping rope body, and the rope skipping counting device is provided in the handles; and the skipping rope further comprises a rectification energy storage power supply and a Bluetooth module in the handles for fixing the two ends of the skipping rope body, the rectification energy storage power supply is connected to the rope skipping counting device and the pose detector, and the Bluetooth module is connected to the rope skipping counting device.

4. A method for rope skipping counting, comprising:

acquiring pose information of a skipping rope body detected by a pose detector, wherein the pose detector is rotatably sleeved on the skipping rope body of a skipping rope; and controlling a counter to perform rope skipping counting processing according to the pose information;

wherein the pose detector is sleeved at a middle position of the skipping rope body; the pose detector is connected to a rope skipping counting device via an electric brush; the pose detector comprises a hollow pose detector housing, a piezoelectric sensor, and a mass block; one side of the piezoelectric sensor is fixedly connected to the mass block, and the other side of the piezoelectric sensor far away from the mass block is fixed on an inner wall of the pose detector housing, and the pose detector is sleeved on the skipping rope body via the pose detector housing; and the piezoelectric sensor is a piezoelectric ceramic sensor and has a mass greater than a mass of the mass block, the acquiring the pose information of the skipping rope body detected by the pose detector comprises:

acquiring voltage information detected by the piezoelectric sensor.

5. The method of claim 4, wherein the controlling the counter to perform the rope skipping counting processing according to the pose information comprises:

determining the valid number of rope skipping according to the voltage information and a preset reference voltage; and controlling the counter to perform the rope skipping processing based on the valid number of rope skipping.

6. A rope skipping counting device, comprising a processor and a memory for storing a program, wherein the program comprises an instruction, and when the processor invokes the instruction, the processor is configured to implement the method of claim 5.

7. The method of claim 5, wherein the determining the valid number of rope skipping according to the voltage information and the preset reference voltage and controlling the counter to perform the rope skipping processing based on the valid number of rope skipping comprise:

acquiring the voltage information at a last time instant previous to a present time instant, in response to the voltage information acquired at the present time instant being greater than the preset reference voltage;

determining that valid one time of rope skipping is completed and controlling the counter to add a counting value by one, in response to the voltage information acquired at the last time instant previous to the present time instant being less than the preset reference voltage; and/or controlling the counter to maintain a counting value, in response to the voltage information acquired at the present time instant being less than or equal to the preset reference voltage; and/or controlling the counter to maintain the counting value, in response to the voltage information acquired at the present time instant being greater than the preset reference voltage and the voltage information acquired at the last time instant previous to the present time instant being greater than or equal to the preset reference voltage.

8. A rope skipping counting device, comprising a processor and a memory for storing a program, wherein the program comprises an instruction, and when the processor invokes the instruction, the processor is configured to implement the method of claim 7.

9. The method of claim 4, further comprising:

receiving an instruction for resetting the counter, and resetting a counting value of the counter to zero; and sending the counting value of the counter to a mobile terminal.

10. A rope skipping counting device, comprising a processor and a memory for storing a program, wherein the program comprises an instruction, and when the processor invokes the instruction, the processor is configured to implement the method of claim 9.

11. A rope skipping counting device, comprising a processor and a memory for storing a program, wherein the program comprises an instruction, and when the processor invokes the instruction, the processor is configured to implement the method of claim 4.

* * * * *